United States Patent [19]

McCole

[11] Patent Number: 4,693,963

[45] Date of Patent: Sep. 15, 1987

[54] SELF-DEVELOPING INTEGRAL FILM UNIT

[75] Inventor: Thomas P. McCole, South Natick, Mass.

[73] Assignee: Polaroid Corporation, Cambridge, Mass.

[21] Appl. No.: 846,614

[22] Filed: Apr. 1, 1986

[51] Int. Cl.[4] ..... G03C 3/00

[52] U.S. Cl. ..... 430/499; 430/207; 430/208; 354/304

[58] Field of Search ..... 430/207, 208, 499; 354/304

[56] References Cited

U.S. PATENT DOCUMENTS 3,652,281 3/1972 Bachelder et al. ..... 430/209

3,761,268 9/1973 Land et al. ..... 430/207

4,356,248 10/1982 McCole ..... 430/209

*Primary Examiner*—Richard L. Schilling

*Attorney, Agent, or Firm*—Stanley H. Mervis

[57] ABSTRACT

This application discloses novel self-developing film units of the integral type. The film units have spacers or rails positioned between the superposed sheets for controlling the thickness of the applied layer of processing fluid. The rupturable pod is attached to the remainder of the film unit at only one edge, so that it may "float" after the processing fluid has been applied. A spacer is bonded to the mask in the area overlying the pod. The mask may be folded over and around only the leading and trailing ends of the film unit.

5 Claims, 4 Drawing Figures

SELF-DEVELOPING INTEGRAL FILM UNIT

This invention relates to photography and more particularly, to novel and improved film units of the self-developing type.

BACKGROUND OF THE INVENTION

Self-developing film units of the integral type, i.e., the film unit is not peeled apart to view the final image, have become very popular since the introduction of Polaroid SX-70 film in 1972. These film units comprise two sheets, i.e., sheet-like elements, held in superposed relationship before, during and after exposure and processing (development). A rupturable container, or pod, releasably holding a processing composition is mounted at one end of the film unit (the leading end), positioned to distribute the processing composition between the superposed sheets. A trap to receive excess processing fluid is mounted at the opposite, or trailing, end of the film unit from the pod. All four edges are sealed to prevent leakage of the processing fluid and to help maintain the integrity of the developed picture. The assemblage may be held together by a mask having an aperture defining the image area. The layers carried on the inner surfaces of the two sheets include the appropriate silver halide emulsion layer(s), the appropriate image-receiving layer for forming a positive image by transfer (unless there is no image transfer, i.e., only a negative image is being formed) and the image-providing materials, usually preformed dyes or dye intermediates or precursors, and the other components as appropriate for the particular image-forming process. When the exposed film unit is advanced pod-end first between a pair of pressure-applying members, e.g., pressure rollers, the pod is ruptured and the released processing fluid is distributed or spread in a thin layer of predetermined thickness between the superposed sheets, any excess fluid being collected in the trap. The thickness of the applied layer of processing fluid is determined, at least in part, by the combined thicknesses of the mask and rail, if any, making up the thickness of the lateral border area. Special configurations may be given to the rollers to ensure that the processing fluid is spread in desired thickness.

Integral film units of the above type wherein exposure and image viewing are effected from the same side of the film unit are described, for example, in U.S. Pat. No. 3,415,644 issued Dec. 10, 1968 to Edwin H. Land, U.S. Pat. No. 3,652,268 issued Mar. 28, 1972 to Albert J. Bachelder and Frederick J. Binda, U.S. Pat. No. 3,761,268 issued Sept. 25, 1973 to Edwin H. Land and Richard J. Chen, and U.S. Pat. No. 4,356,248 issued Oct. 26, 1982 to Thomas P. McCole. Integral film units wherein exposure and viewing are effected from opposite sides are described, for example, in U.S. Pat. No. 3,594,165 issued Jul. 20, 1971 to Howard G. Rogers, and in U.S. Pat. No. 4,042,395 issued Aug. 16, 1977 to Frederick F. Tone, et al.

Film units of the type described in the above-noted Land U.S. Pat. No. 3,415,644 were initially commercialized as Polaroid SX-70 film and have included a mask member overlying the positive sheet and extending around the four edges of the film unit, as more clearly shown, for example, in the above-mentioned McCole U.S. Pat. No. 4,356,248. Spacer elements or rails positioned along the lateral edges of the film unit and designed to control the thickness of the applied layer of processing composition by controlling the spacing apart of the pressure rollers have been positioned under the folded-over mask edge, as in the above-noted McCole U.S. Pat. No. 4,356,248, or between the superposed sheets, as disclosed in the above-noted Bachelder, et al. U.S. Pat. No. 3,652,281 (note FIG. 4).

Film units of the type described in the above noted Tone, et al. U.S. Pat. 4,042,395 and originally commercialized as Kodak PR-10 film have utilized an image area-defining member or mask positioned between the lateral edges of the superposed sheets and which was wrapped around the leading and trailing ends to form pod and trap areas. In such a construction, the mask also may serve as a rail or a separate rail may be utilized in combination with the mask and also positioned between the lateral edges of the superposed sheets, as shown, for example, in U.S. Pat. No. 4,017,879 issued April 12, 1977 to Peter Lermann, et al. and in U.S. Pat. No. 4,460,255 issued July 17, 1984 to Katsuya Kozai, et al.

As shown, for example, in the above-noted Land, et al. U.S. Pat. No. 3,761,268, the photosensitive element may be shorter than the positive element.

SUMMARY OF THE INVENTION

The present invention provides self-developing film units of the integral type which are not as thick at the pod and trap ends as previous integral film units. Improved control of the distribution of the layer of processing composition within the film unit is possible. These film units incorporate a spacer element mounted on the inner surface of the image-carrying sheet over the pod, or to the mask if the image-carrying sheet does not cover the pod, and the pod is attached to the mask only at the leading end of the pod. Spacers or rails are positioned between the superposed sheets along the lateral edges to provide a predetermined thickness of processing composition over the image area, and to secure the sheets to each other.

THE DRAWINGS

The manner in which film units in accordance with this invention are constructed will best be understood by the following detailed description, taken together with the accompanying drawings, wherein.

DETAILED DESCRIPTION OF THE INVENTION

Figure 1:
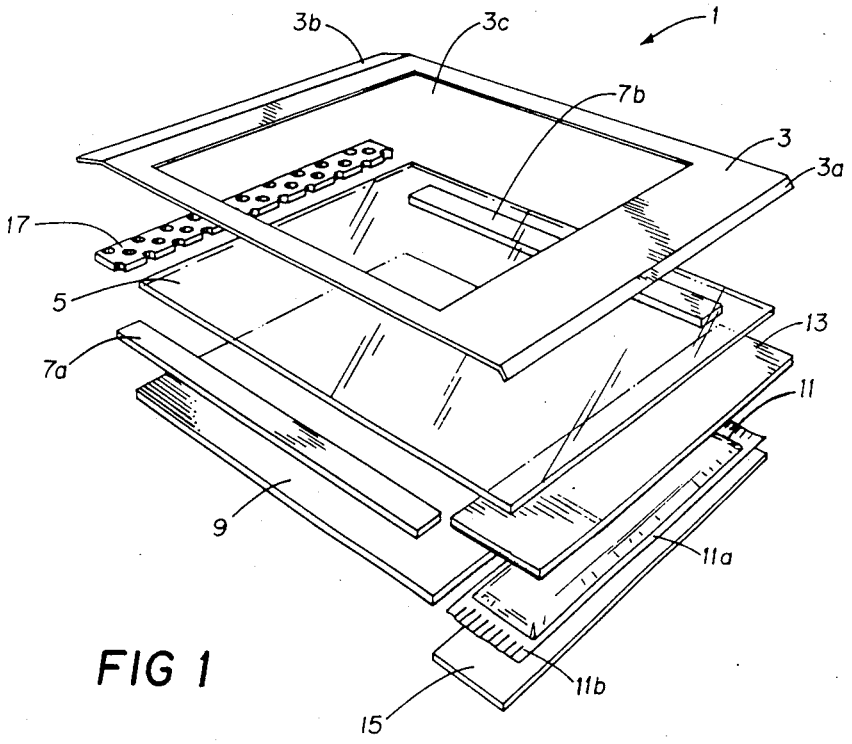
FIG. 1 is an exploded perspective view of a self-developing integral film unit constructed in accordance with this invention.
Figure 3:
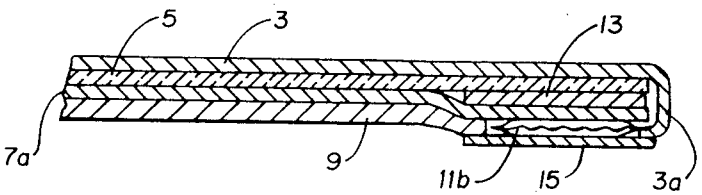
FIGS. 2 and 3 are enlarged cross-sectional views, respectively of the trap, or trailing, end and the pod, or leading, end of the film unit of FIG. 1 through the region of the inner rail.
Figure 2:
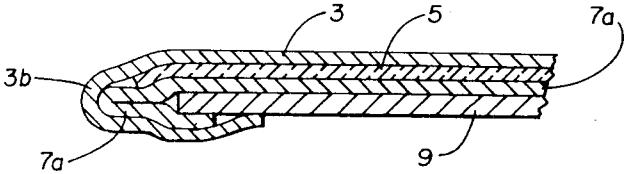

As noted above, FIG. 1 is an exploded perspective view of a film unit 1 of the Polaroid SX-70 film type constructed in accordance with this invention, while FIGS. 2 and 3, respectively, are diagrammatic cross-sections of the trailing or trap end of the film unit 1 and of the pod or leading end of the film unit 1 in the area of the laterally positioned longitudinal spacers or rails 7*a* and 7*b*. Viewing FIGS. 1, 2 and 3 together, there is shown a transparent positive sheet-like element 5 in superposed relationship with a photosensitive or negative sheet-like element 9 having an opaque outer support. The two sheets are of the same width but different lengths, and are spaced apart by longitudinal spacers or rails 7*a* and 7*b* laminated to the inner surfaces of the positive and negative sheets 5 and 9 along the aligned lateral edges thereof. A pod 11 is mounted at the leading end of the film unit with the pod's rupturable edge seal positioned to release a viscous processing composition contained within the pod for distribution between the superposed positive and negative sheets 5 and 9. The positive sheet 5 is longer than the negative 9, and extends over the pod 11 as shown in FIG. 3. At the trailing end of the film unit 1 there is positioned a trap, including a trap spacer element 17, to collect excess processing fluid, said trap being formed by a space after the trailing end of the negative sheet 9 taken in combination with the trailing end 3*b* of the binding element or mask 3 within which spacer element 17 is positioned. The spacer element 17 is secured to the mask trailing end 3*b* and positioned with its leading edge under the trailing end of the negative sheet 9. The mask or binding member 3 has an aperture 3*c* therein defining the image area, and is laminated to the outer surface of the transparent positive sheet 5. The longitudinal spacers or rails 7*a* and 7*b* are laminated to the facing lateral margins of the positive and negative. As best seen in FIG. 3, a spacer element 15, sometimes referred to as a "pod tape", is laminated at one transverse edge to the back of the negative 9 and at the other transverse edge spacer 15 is laminated to the outer surface of the leading edge 3*a* of the mask 3 after it has been folded around the leading edges of the positive and negative sheets 5 and 9. A spacer element 13, sometimes referred to as a "jump tape", is laminated to the inner surface of the positive sheet 5 over the pod 11. The spacer element 15 is a little wider than the pod 11, providing a gap or space between the rupturable edge seal of the pod 11 and the leading edge of the negative sheet and this construction facilitates application of the processing composition onto the negative after the pod is ruptured. The spacer element 13 extends a short distance beyond the rupturable edge of the pod 11 and between the negative 9 and the positive 5 and prevents the layer of processing fluid being too thin at the leading edge of the image area. The rupturable pod is held in position by having its leading edge 11*a* secured to the portion 3*a* of the mask which is folded over or wrapped around the leading end of the film unit, and by the longitudinal rails 7*a* and 7*b*. Neither the spacer 13 nor the spacer 15 is laminated to the rupturable pod 11, thus permitting the pod 11 to "float" attached to the mask 3 only by its leading edge 11*a*. The portion of the mask 3 overlying the pod 11 provides a wide border, and may be used for holding the print (without touching the image area) and for recording information relative to the image if so desired. As a result of this novel assembly, the natural handling of the film unit by the wide border (pod area) immediately after processing is much less likely to cause the negative 9 and the positive 5 to separate and create a visible line or bar at the edge of the image as a result of flexing this portion of the film unit before processing is completed.

The mask 3 may comprise a substrate of liquid impermeable aluminized polyester or the like, pigmented on one side to provide an attractive border for the film unit, and coated on the other side with a suitable adhesive, such as poly(ethylene/vinyl acetate) to permit the mask to be laminated to the other components of the film unit. Typically, the mask material will be quite thin, for example, from 0.0015 to 0.0020 inch in thickness.

In assembling film units of this invention, it is advantageous to laminate the mask 3 to the positive sheet 5, then laminate the rails 7*a* and 7*b* to the positive sheet 5, and then laminate the negative 9 to the rails 7a- and 7*b*.

An important feature in the assembly of the film unit is that while the rails 7*a* and 7*b* are adhered along their complete length to the superposed sheets, or to the sheets and the mask, the rails are not so adhered across their entire width. This construction leaves the inner portions of the rails 7*a* and 7*b* unattached to either sheet immediately adjacent the image area, permitting the processing composition to flow over and under both surfaces of the rails until it reaches the laminated portion, thereby aiding to obtain complete coverage of the image area by the processing composition. Thus, for example, if the width of the mask 3 overlying the rails 7*a* and 7*b* is approximately 0.200 inch, the inner 0.060 inch wide portion of the rail is left unlaminated. The thickness of the rails 7*a* and 7*b* are determined by the desired thickness of the layer of processing composition to be applied.

A suitable material for the inner rails is a composite of 0.0005 inch thick condenser tissue paper laminated to both sides of a 0.0014 inch thick white polyester with black laminating adhesive, with a thermal-activated adhesive coated on the tissue paper, the laminate being about 0.0029 inch thick. The polyester is pigmented to prevent light leakage through the edge of the film unit. The recited thickness is illustrative only and may be thicker or thinner as appropriate for the particular film unit. The thermal-activated adhesive coated on each side of the rails may be the same or different, as appropriate to obtain effective bonding to the surfaces of the sheets 5 and 9.

Figure 4:
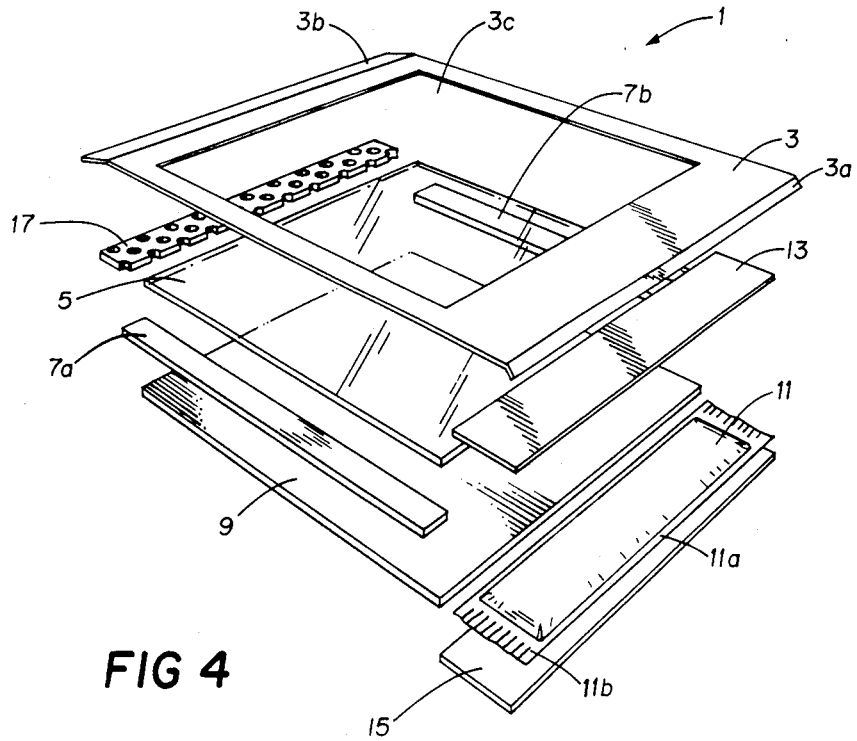
FIG. 4 is an exploded perspective view of an integral film unit incorporating a different embodiment of this invention.

While the pod 11 is shown in FIGS. 1 and 4 as having a single compartment, it will be understood that the pod may be divided into several compartments, as shown, for example, in the above-noted McCole U.S. Pat. No. 4,356,248, and such a construction is preferred.

Referring now to FIG. 2 showing the trap or trailing end of the film unit 1, the rails 7*a* and 7*b* are adhered to the outer surface of the trailing end of the negative sheet 9, the inner surface of the negative sheet 9, and the inner surface of the positive sheet 5. In addition, the rails 7*a* and 7*b* are adhered to the inner surface of the mask 3 and therefore to themselves in the area between the trailing end of the negative element 9 and the trailing end 3*b* of the mask 3 where it is folded around the trailing end of the film unit. The mask 3 also is adhered to the outer surface of the negative 9 and to the rails 7*a* and 7*b* where they extend and adhere to the outer surface of the negative 9. This insures that excess processing composition will not leak from the processed film unit.

The spacer element 17 in the trap as shown in FIGS. 1 and 4 is perforated to provide apertures constituting about 15 to 25% of the volume occupied by the rectangular outline of the spacer 17, thereby providing additional space (volume) for excess processing fluid. The spacer element 17 preferably is one which has been reacted or treated with an acid, e.g., citric acid, to provide neutralizing capability with respect to the excess processing composition, as described in U.S. Pat. No. 3,761,269 issued Sept. 25, 1973 to Richard F. Chen. The spacer 17 may be of conventional composition, e.g., formed of a fibrous liquid absorbent paper board approximately 0.013 inch in thickness.

In a particularly preferred embodiment, the spacer element 17 is perforated only over its central area, with no apertures over approximately the first 0.5 inch of its length from either end. Since the photosensitive or negative element 9 overlies the leading edge of spacer element 17, excess processing composition will flow over the solid portions. This permits a slightly narrower corresponding and opposed area of the trailing end 3*b* of the mask 3, which would otherwise be adhered to the outer surface of the negative 9, to be left unadhered to provide vents for air displaced by the spreading of the processing composition.

From the foregoing description it will be seen that inner rails 7*a* and 7*b* provide the means for maintaining the lateral margins of the film unit as an integral laminate, thereby avoiding any necessity for the mask to be folded over and around the lateral edges. The construction of the rails 7*a* and 7*b* is such that they do not permit the transmission of ambient light to the interior of the film unit, thereby preventing unwanted fogging of the negative during processing after the film unit has exited the camera.

As a particular example, the film unit may be approximately 4.0 by 4.1 inches, overall, with the mask aperture defining a rectangular image area approximately 3.6 by 2.9 inches, and the pod positioned along the longer dimension of the image area. In such a film unit, the pod may be formed of a vinyl coated, paper backed lead foil approximately 1.125 inches wide which is folded in half and sealed to form the pod in conventional manner. The pod tape or spacer 15 may comprise a laminate of tissue paper to both sides of a biaxially oriented polyester approximately 0.00032 inch thick, the inner surface of this laminate being coated with an alkali barrier and an ethylene/vinyl acetate heat seal adhesive; this spacer 15 may have a total thickness of about 0.7 mil and a width of approximately 0.78 inch. The jump tape or spacer 13 may comprise a 0.48 mil clear polyester laminated on each side to 0.45 mil condenser tissue paper, with an outer coating of a urethane type heat seal adhesive, with a total thickness of approximately 1.77 mil and a width of approximately 0.78 inch. The rails 7*a* and 7*b* may be about 4.2 inches long, including the folded over portion thereof.

Selection of the several heat sensitive (activated) adhesives will depend upon the composition of the layers and surfaces being laminated and the conditions of heat and pressure desired to be used during the various lamination steps. It will be apparent that those adhesives which may come in contact with the processing fluid should resist attack by alkali and water. Since the rails 7*a* and 7*b* have adhesives on two surfaces, it is desirable that they be selected such that the conditions of heat and pressure used to activate the first adhesive to be bonded do not also activate the second adhesive. Sheets 5 and 9 need not be of the same thickness; in the preferred embodiment, the positive sheet 5 is thinner and comprises a 2.5–3.0 mil transparent polyester film containing a small quantity of anti-light-piping pigment or dye and carrying the image-receiving layer, while the negative sheet 9 comprises a 4.0–5.0 mil opaque polyester film carrying the various photosensitive and other layers customarily included in this component.

In a modification of the film unit shown in FIG. 4, the positive sheet 5 is shorter than in FIG. 1 and of substantially the same length as the negative sheet 9. The spacer element 13 is laminated to the mask 3 and now acts as an extension of the positive sheet 5, and the spacer 13 in this structure therefore is somewhat thicker than in the structure shown in FIG. 1. The additional thickness replaces part of the stiffness imparted to the film unit by the longer positive sheet 5 in FIG. 1 to facilitate feeding the film unit between the pressure rollers. When such a film unit is passed between a pair of pressure rollers to rupture the pod 11 and distribute the processing composition, the reduced thickness and greater flexibility of the spacer element 13, as compared with the support for the positive sheet 5, permits greater and more uniform pressure to be applied to the pod thereby leaving less processing composition in the pod. This greater utilization of the processing composition permits one to put less processing composition in the pod initially and still obtain the same coverage of processing composition per unit area. In addition, use of the spacer element 13 to replace a portion of the positive sheet 5 provides a savings in the component cost of the film unit.

The film structure shown in FIG. 4 also lends itself to the manufacture of film units designed to have the pod portion removed from the processed film unit since the positive and negative elements 5 and 9 do not extend over the pod 11. If such a film unit is desired, appropriate perforations may be made in the mask 3, for example, at a point near the inner edge of the spacer element 13, with corresponding perforations also in the spacer element 15, a short distance from the ends of elements 5 and 9. In this modification, the rails 7*a* and 7*b* would terminate just before or at the perforations. Alternatively, the perforations may be so positioned that spacer 13 and spacer 15 both are removed. After the pod portion is detached, the resulting "open" edge of the film unit at the point of detachment may be sealed, e.g., by a pressure sensitive or alkali-activated adhesive on one or both of the facing surfaces, thereby protecting the integrity of the developed film unit and also preventing fluid leakage from this area.

While the above description of preferred embodiments of this invention have been with reference to film units of the general type described in the above-noted Land U.S. Pat. No. 3,415,644, it will be expressly understood that similar films units may be constructed utilizing the arrangement of layers described in the above-noted Rogers U.S. Pat. No. 3,594,165 without departing from the scope of this invention.

While the mask 3 has been described in connection with FIGS. 1 through 4 as including extensions 3*a* and 3*b* extending around and under the leading or pod end and the trailing or trap end of the film unit, it will be understood that the mask 3 also may be provided with extensions to fold over and under the two remaining (lateral) edges of the film unit, e.g., in a manner analogous to that shown in the above-noted McCole U.S. Pat. No. 4,356,248, if desired for appearance purposes. In this event, the thickness of the inner rail may be reduced to compensate for the extra thickness resulting from the folded-over mask.

While the invention has been described with illustrative reference to the details of specific embodiments, many changes and variations will be apparent to those skilled in the art, and such can obviously be made without departing from the scope of the invention.

What is claimed is:

1. A photographic film unit adapted to be exposed and then processed to form a visible image in an area thereof by moving said film unit relative to and between pressure applying members to distribute a processing composition within said film unit toward the trailing end thereof, said film unit comprising first and second sheets of substantially equal widths, at least one of said sheets comprising photosensitive constituents; a rupturable pod releasably containing a processing composition and positioned at the leading end of said film unit so as to discharge said processing composition for distribution between said first and second sheets; a trap for receiving excess processing composition, said trap being positioned at the opposite, trailing end of said film unit from said pod; a mask adhered to the outer surface of said first sheet, said mask having an aperture therein defining an image area, said mask extending over and around the leading edge of said film unit adjacent said pod and over and around the trailing edge of said film unit adjacent said trap; a spacer element slightly wider than said pod and positioned over but not bonded to said pod and extending beyond the rupturable edge of said pod, said spacer element being laminated to the inner surface of said mask, or to the inner surface of said first sheet if said first sheet is laminated to said mask in the area over said pod, said pod being attached to said mask only by the leading edge of said pod, whereby said pod is free to move toward or away from said spacer element; rails extending along the lateral edges of said film unit to determine the thickness of the distributed processing fluid, said rails being positioned between said sheets and laminated to said sheets and to said spacer element.

2. A photographic film unit as defined in claim 1, wherein said first sheet is longer than said second sheet, said first sheet extends over said pod, and said spacer is laminated to said first sheet.

3. A photographic film unit as defined in claim 1 wherein the leading edge of said first sheet and the leading edge of said second sheet are substantially aligned, said spacer is laminated to said mask and said film unit is perforated to facilitate detachment of the pod-containing portion after said processing composition has been distributed.

4. A photographic film unit as defined in claim 1, wherein a second spacer element slightly wider than said pod is positioned under but not attached to said pod, said second spacer being attached to the leading edge of said second sheet and to the edge of said mask extended over the leading edge of said film unit.

5. A photographic film unit as defined in claim 1, wherein said rails are laminated to said first and second sheets over only the outer portion of the width of the rails, whereby distributed processing composition may flow over both surfaces of the inner portion of said rails up to said laminated portion.

* * * * *